US007182984B2

(12) United States Patent
Kohno et al.

(10) Patent No.: US 7,182,984 B2
(45) Date of Patent: Feb. 27, 2007

(54) INK JET-RECORDING MEDIUM AND METHOD FOR PRODUCING THE SAME

(75) Inventors: Kenji Kohno, Ibaraki (JP); Noriaki Ohtani, Ibaraki (JP)

(73) Assignee: Hitachi Maxell, Ltd., Osaka (JP)

( * ) Notice: Subject to any disclaimer, the term of this patent is extended or adjusted under 35 U.S.C. 154(b) by 0 days.

(21) Appl. No.: 09/979,067

(22) PCT Filed: Mar. 13, 2001

(86) PCT No.: PCT/JP01/01933

§ 371 (c)(1),
(2), (4) Date: Feb. 13, 2002

(87) PCT Pub. No.: WO01/70510

PCT Pub. Date: Sep. 27, 2001

(65) Prior Publication Data

US 2003/0031839 A1 Feb. 13, 2003

(30) Foreign Application Priority Data

Mar. 17, 2000 (JP) ..... 2000-076845
Sep. 19, 2000 (JP) ..... 2000-283246

(51) Int. Cl.
*B41M 5/40* (2006.01)

(52) U.S. Cl. ..... 428/32.35; 428/32.21; 428/32.25; 428/32.3; 428/32.36; 427/243

(58) Field of Classification Search ..... 428/195, 428/206, 297.4, 325, 326, 329, 32.21, 32.25, 428/32.3, 32.35, 32.36; 427/243
See application file for complete search history.

(56) References Cited

U.S. PATENT DOCUMENTS 5,017,268 A * 5/1991 Clitherow et al. ..... 162/146
5,372,884 A * 12/1994 Abe et al. ..... 428/331
5,830,317 A * 11/1998 Vinson et al. ..... 162/125
5,897,961 A * 4/1999 Malhotra et al. ..... 428/195
5,955,142 A * 9/1999 Yoshino et al. ..... 427/205
6,183,851 B1 * 2/2001 Mishima ..... 428/32.34
6,326,323 B1 * 12/2001 Shimano et al. ..... 442/76
6,428,163 B1 * 8/2002 Missell et al. ..... 347/105
6,428,164 B1 * 8/2002 Missell et al. ..... 347/105

FOREIGN PATENT DOCUMENTS

| | | |
|---|---|---|
| DE | A1 36 40 359 | 5/1987 |
| EP | 0 500 021 A1 | 8/1992 |
| EP | 0 933 411 A1 | 8/1999 |
| EP | A1 0 958 932 | 11/1999 |
| GB | A2 184 958 | 7/1987 |
| JP | 08-282091 A | 10/1996 |
| JP | 08-295076 A | 11/1996 |
| JP | 09-020067 A | 1/1997 |
| JP | 09-164750 A | 6/1997 |
| JP | 10-101720 A | 4/1998 |
| JP | 10-114147 A | 5/1998 |
| JP | 11-138983 A | 5/1999 |
| JP | 2000-326621 A | 11/2000 |
| JP | 2001-018335 A | 1/2001 |

* cited by examiner

*Primary Examiner*—B. Shewareged
(74) *Attorney, Agent, or Firm*—Birch, Stewart, Kolasch & Birch, LLP

(57) ABSTRACT

An ink jet-printing medium comprising a substrate and an ink-receptive layer which has at least one layer and is formed on at least one major surface of the substrate, in which at least one layer of the ink-receptive layer contains fibrous fine powder as a pigment in an amount of at least 20% by weight of the total weight of the whole pigment contained in the layer which contains the fibrous fine powder. This medium can be produced at a low cost and has high printing quality while suppressing the discoloration or fading of the prints.

9 Claims, No Drawings

INK JET-RECORDING MEDIUM AND METHOD FOR PRODUCING THE SAME

This application is the national phase under 35 U.S.C. § 371 of PCT International Application No. PCT/JP01/01933 which has an International filing date of Mar. 13, 2001, which designated the United States of America and was published in English.

FIELD OF THE INVENTION

The present invention relates to an ink jet-printing medium and a method for producing the same.

BACKGROUND ART

Ink jet printers eject liquid inks through nozzles having a special structure in a jet form and deposit the inks on a recording medium such as a paper sheet with controlling their flying tracks to print characters, images, etc. and are widely used as the printers of facsimile machines, word processors, personal computers, etc. As a printing medium for ink jet-printing, an ink jet-printing medium is used, which has various properties required for ink jet-printing such as fixing and absorbing properties of the inks for ink jet-printing, density of prints, roundness of each dot shape, sharpness of the periphery of each dot, whiteness, water-resistance, size-stability against moisture absorbing and desorbing, and the like.

To improve the properties which relates to printing quality among these properties, it is effective to provide a coating layer containing a pigment which comprises silica as a main component, and most of commercially available paper sheets have such a coating layer. To increase the whiteness, fluorescent dyes, brighteners or color adjusters such as dyes, pigments, etc. are used.

The ink jet-printing media, in particular, those used to record photographs or graphic data are often used in applications where the media are exposed to light, for example, those hung on walls or those used as displays, or applications where the media are stored for a long time such as albums, work collections, etc. In those applications, the requirement for ink jet-printing media which have high printing quality and cause less discoloration or fading of prints is increasing. Furthermore, the requirement for the reduction of the cost is also increasing, since the currently available ink jet-printing media are expensive.

The pigment which is most widely used as the surface coating of the ink jet-printing media is silica. Silica has a very high surface activity and thus increases the printing quality, but it may accelerate the discoloration or fading of the dyes in the inks for ink jet-printing, or the fluorescent dyes and the brighteners or color adjusters such as dyes and pigments. In addition, silica is generally expensive and thus increases the cost of the ink jet-printing media.

DISCLOSURE OF INVENTION

One object of the present invention is to provide an ink jet-printing medium which overcomes the drawbacks of the conventional ink jet-printing media, achieves high printing quality but causes less discoloration or fading of the prints, and is produced at a low cost.

As a result of extensive study to achieve the above object, it has been found that such an ink jet-printing medium can be obtained when the fine powder of fiber (fibrous fine powder) is used as an ingredient of a pigment which is contained in at least one layer constituting an ink-receptive layer of the ink jet-printing medium which comprises an ink-receptive layer on at least one major surface of a substrate of the medium, and the fibrous fine powder is contained in a specific amount in relation to the pigments contained in the layer which contains the fibrous fine powder (sometimes referred to as "fibrous fine powder-containing layer").

Furthermore, it has also been found that when the fibrous fine powder is used in combination with a cationic component, the effects are further improved.

Accordingly, the present invention provides an ink jet-printing medium comprising a substrate and an ink-receptive layer which comprises at least one layer and is formed on at least one major surface of the substrate, wherein at least one layer of the ink-receptive layer contains fibrous fine powder as a pigment in an amount of at least 20% by weight of the total weight of the whole pigment contained in the layer which contains the fibrous fine powder.

Since the fibrous fine powder is similar to the fibrous component of paper, it has a high absorbance of inks. In addition, since the fibrous fine powder has a short length, it can suppress feathering which may be caused by long cellulose fibers of paper. Thus, the ink jet-printing medium of the present invention may achieve the high printing quality. At the same time, the amount of silica having the high surface activity can be decreased in proportion to the amount of the fibrous fine powder. Therefore, the discoloration or fading of the pints may be suppressed. Furthermore, the ink jet-printing medium of the present invention can be produced at a low cost since the fibrous fine powder is inexpensive.

DETAILED DESCRIPTION OF INVENTION

The fundamental or raw material of the fibrous fine powder is a fiber having ink absorbing properties. Typical examples of such a fiber are natural fibers such as cellulose, cotton, silk, wool, chitosan, etc.

The average fiber length of the fibrous fine powder is preferably 85 μm or less since that the roughness of the prints may not be observable with an eye when the resolution is about 300 dpi (dot per inch) (corresponding to about 85 μm in terms of a center-to-center distance of a pair of adjacent dots). When the fiber length exceeds 85 μm, the feathering becomes noticeable so that the printing quality may deteriorate. The average fiber length of the fibrous fine powder is preferably 60 μm or less, more preferably 30 μm or less.

It may be difficult to produce fibrous fine powder having a length of ten odd micrometers. In the present invention, the fibrous fine powder having such a lower limit length due to the production limit may be used. If the fibrous fine powder having a length shorter than the above lower limit were produced, it could be used in the present invention supposing from the above mechanism. Currently, the lower limit of the fiber length may be 10 μm, preferably 12 μm.

The average fiber length of the fibrous fine powder can be obtained by measuring the length of each of the fibers (for example, 50 particles) along the major axis present in a specific area of an image observed or photographed with an optical or electron microscope and averaging the measured lengths.

The average diameter of the fibrous fine powder is preferably 85 μm or less for the same reason as described above. In general, since the diameter is less than the length, the average diameter of the fibrous fine powder is satisfactory when the average length is in the above range.

When the length and diameter are close each other, the size of the fibrous fine powder may be expressed in terms of a particle size, and an average particle size is preferably 85 μm or less. In this case, the particle size may be measured with any conventional method for measuring a particle size such as a method using an optical or electron microscope like the above-described method, a centrifugal sedimentation method, a Coulter Counter method, a laser scattering method, etc.

The fibrous fine powder to be used in the present invention maybe produced by any method. For example, the conventional fiber is optionally size-reduced with chemical or mechanical pretreatment and then mechanically ground or dispersed in water under high pressure, or the fiber is dissolved or dispersed in a liquid medium (solvent) and then spray dried. Alternatively, the fibrous fine powder may be chemically synthesized.

The pigment contained in at least one layer of the ink-receptive layer may consist of the fibrous fine powder alone, although the fibrous fine powder may be used together with other pigment such as silica, alumina, calcium carbonate, resin particles, coloring pigments, etc. The amount of the fibrous fine powder is at least 20% by weight, preferably at least 50% by weight based on the whole weight of the pigment(s) contained on the fibrous fine powder-containing layer so that the discoloration or fading of the prints caused by light is prevented or suppressed.

A binder may be used together with the fibrous fine powder to fix the fibrous fine powder on the substrate or other layer formed on the substrate.

Various resins may be used as the binder Examples of the binder resins include water-soluble resins such as polyvinyl alcohol (PVA), polyvinylpyrrolidone, carboxymethylcellulose (CMC; sodium cellolose glycolate), hydroxyethylcellulose, casein, gelatin, starch, sodium alginate, etc.; and emulsions of synthetic resins such as polyvinyl acetate, vinyl chloride-vinyl acetate copolymers, styrene-butadiene copolymers, polyurethane, acrylic copolymers, maleic acid copolymers, etc. They may be used independently or as a mixture of two or more.

When a dye (or pigment) in the ink for ink jet-printing is an aqueous anionic dye which is nowadays widely used, it is effective to retain the dye in the fibrous fine powder-containing layer so as to further improve the effect for suppressing the discoloration or fading of the prints caused by light. Thus, a cationic component is preferably contained in the fibrous fine powder-containing layer to retain a larger amount of such a dye in the layer.

When the fibrous fine powder-containing layer is provided as the outermost layer or when other layer formed on the fibrous fine powder-containing layer is highly transparent, the cationic component is preferably added to the fibrous fine powder-containing layer so that as much amount as possible of the aqueous dye can be retained in the fibrous fine powder-containing layer. In such a way, the print density increases since the large amount of the aqueous dye can be retained in domains where the aqueous dye can be seen from the surface side.

A cationic binder may be used. Examples of the cationic binder include the above resins to which an amine salt group or an ammonium salt group is bonded, copolymers of the above resins with a monomer having such a functional group, etc.

Apart from the binder, a cationic component such as a cationic polymer or agent may be used. In this case, the binder used is preferably nonionic or cationic, since anionic binders and the cationic polymer or agent tend to coagulate.

Examples of the cationic agent include low molecular weight compounds (e.g. long-chain alkylamine salts, long-chain alkyl-dimethylamines, long-chain alkyl-trimethylammonium salts, etc.); homo- or copolymers of allylamine or its salt, diallyldimethylammonium salts, dialkylaminoethyl acrylate or methacrylate, trialkylammoniumethyl acrylate or methacrylate, diethylaminostyrene, etc.; or copolymers of such monomers with other comonomers; polyalkylenepoyamines, dicyandiamide resins, and the like.

The amount of the cationizing polymer, which is used in addition to the binder, depends on the pigment selected, the binder and their ratio. In general, the amount of the cationizing polymer is 100% by weight or less of the binder, and at least 1% by weight of the pigment. When the amount of the cationizing polymer exceeds 100% by weight of the binder, it is difficult to maintain the bound state of the layer, since the cationizing polymer has relatively low strength. When the amount of the cationizing polymer is less than 1% by weight of the pigment, it is difficult to allow the aqueous dye in the ink to exhibit its fixing property. Preferably, the amount of the cationizing polymer does not exceed 80% by weight of the binder and is at least 2% by weight of the pigment.

The fibrous fine powder or the pigment other than the fibrous fine powder may be cationic. For example, a cationic pigment may be used separately from the fibrous fine powder, or the fibrous fine powder or other pigment, which is made cationic, may be used.

Examples of the cationic pigment include aluminum compounds such as alumina, aluminum hydroxide, hydrous aluminum oxide, etc.; powder of the cationizing polymers described above; and the like.

Examples of the cationizing treatment include the addition of the above aluminum compounds to the surface or pores of the fibrous fine powder, inorganic pigment or organic pigment through adhesion, deposition or doping; chemical or physical adsorption of amine salts, ammonium salts or the cationizing polymers to the surface or pores of the fibrous fine powder, inorganic pigment or organic pigment; inorganic or organic pigments the functional groups of which present on their surface or in the pores are substituted with cationic functional groups; and the like.

The amount of the cationic pigment is selected such that the amount of the fibrous fine powder is at least 20% by weight, preferably at least 50% by weight, of the weight of the whole pigment(s) contained in the fibrous fine powder-containing layer.

Apart from the pigments, the binder and the cationizing polymer, the ink-receptive layer comprising the fibrous fine powder-containing layer may contain other additives, if necessary. Examples of the other additives include surface modifiers, defoaming agents, dispersants, viscosity-regulators, water resistance-imparting agents, coloring dyes, fluorescent dyes, fungicides, antistatic agents, lubricants, anti-dusting agents, water-retention agents, etc.

The amount of the components other than the pigments (e.g. the binder, the cationic components, etc.) in relation to the pigments including the fibrous fine powder preferably does not exceed 150% by weight, more preferably 75% by weight in terms of the solid weight to achieve the good ink-absorption. In particular, the amount of the components other than the pigments is 40% by weight or less if the binder has a high binding force. The amount of the binder necessary for the suppression of the dropping of the fibrous fine powder depends on the binding force of the binder, but is preferably at least 3% by weight, preferably at least 5% by weight of the pigments The thickness of the whole ink-receptive layer is at least a thickness at which the fibrous fine powder covers all the surface area in the form of a single layer (close to the average diameter) and up to about 100 μm. When the thickness of the ink-receptive layer is less the above lower limit, it is difficult to form prints with fewer blurs. When the thickness of the ink-receptive layer exceed the above upper limit, the coated film tends to crack, and a domain, which does not contribute to the ink reception of the lower part of the ink-receptive layer, increases and thus the cost unnecessarily increases. More preferably, the thickness of the whole ink-receptive layer does not exceed 70 μm.

The ink-receptive layer may have a multilayer structure having two or more layers. In such a case, the fibrous fine powder-containing layer may be used as a lower layer, a middle layer or a top layer. For example, the fibrous fine powder-containing layer is used as the lower layer, while a layer which can impart a specific appearance such as gloss to the surface or a layer which can form prints with better quality than the fibrous fine powder-containing layer is provided as the top layer.

Pigments which may be contained on the layer other than the fibrous fine powder-containing layer may be the pigments other than the fibrous fine powder or the cationic pigments, which are explained above. Examples of the cost-effective pigments, which has good adaptability with the ink jetting, are silica, alumina, calcium carbonate, etc. The ink-receptive layer may have two or more fibrous fine powder-containing layers.

When the fibrous fine powder-containing layer is used as the top layer, that is, the surface layer, particularly when the fibrous fine powder-containing layer contains the cationic component and is used as the top layer, it can most significantly achieve the effect to suppress the discoloration or fading of the prints, since the inks infiltrate into the ink-receptive layer from its surface.

The substrate on which the ink-receptive layer is formed may be made of any kind of materials which can be printed with the ink jet printers. Examples of the substrate include a paper sheet, a resin film, a fabric, etc. In particular, when the substrate having the relatively high surface smoothness and compactness such as the paper sheet or resin film is used, the surface uniformity of the ink-receptive layer increases so that the prints with high definition can be produced. It may be possible to interpose various layers between the substrate and the ink-receptive layer. Examples of such interposed layers may be an easy-adhering layer, an antistatic layer, a coloring layer, a metal-deposition layer, etc.

The ink-receptive layer may be formed on one or both major surfaces of the substrate. Alternatively, the ink-receptive layer is formed on one major surface of the substrate, while a layer other than the ink-receptive layer is formed on the other major surface of the substrate. For example, the antistatic layer, the coloring layer, the metal-deposition layer, a curl-preventing layer, a slippage-adjusting layer, a layer suitable for printing other than ink jet-printing, a decorative layer, etc. maybe formed, in necessary.

The ink jet-printing medium of the present invention may be produced by any conventional method. A typical production method will be explained below.

Firstly, the substrate may be surface treated or provided with a primer layer, if desired. Then, a coating composition comprising the fibrous fine powder, the binder which may be cationic, optionally the cationic component and optionally other components is applied on the substrate with a conventional coating means such as a blade coater, an air knife coater, a reverse-roll coater, a bar coater, a gravure coater, a die coater, etc. Then, the surface of the coated composition may be smoothened with a smoothing apparatus such as a super calender, a gloss calender, a thermoplanisher, etc., if desired.

Secondly, at least one top layer maybe formed on the fibrous fine powder-containing layer, if necessary. However, the top layer should not deteriorate the printing properties of the ink jet-printing. For example, a gloss layer, a layer which enables the high definition printing, a protective layer, a UV-absorbing layer, etc. may be formed as the top layer or layers.

EXAMPLES

The present invention will be illustrated with the following Examples, which do not limit the scope of the present invention in any way. Hereinafter, "parts" and "%" are by weight.

Example 1

The following components were mixed to obtain Surface Layer Coating A having a solid content of 20%:

| | |
|---|---|
| Cellulose fine powder<br>(ARBOCEL BE600-10 available from J. Rettenmaier & Söhne GMBH & CO.)<br>an average length of 18 μm;<br>an average diameter of 15 μm) | 100 parts |
| Polyvinyl alcohol<br>(POVAL PVA-217 available from KURARAY, Co., Ltd.) | 40 parts |
| Cationic agent<br>(PAS-H-10L available from Nitto Boseki Co., Ltd.) | 10 parts |
| Water | 575 parts |

Surface Layer Coating A was coated on a base paper for a coated paper having a weight of 85 g/m$^2$ with a #44 bar coater and dried to obtain an ink jet-printing medium of this Example.

Example 2

An ink jet-printing medium of this Example was produced in the same manner as in Example 1 except that the amounts of the polyvinyl alcohol and the cationic agent were changed to 80 parts and 20 parts respectively.

Example 3

An ink jet-printing medium of this Example was produced in the same manner as in Example 1 except that the amounts of the polyvinyl alcohol and the cationic agent were changed to 16 parts and 4 parts respectively.

Example 4

An ink jet-printing medium of this Example was produced in the same manner as in Example 1 except that the amounts of the polyvinyl alcohol and the cationic agent were changed to 14 parts and 4 parts respectively, and 2 parts of a water resistance-imparting agent (Sumirez Resin 613 available from Sumitomo Chemical Co., Ltd.) was added.

Example 5

An ink jet-printing medium of this Example was produced in the same manner as in Example 1 except that the amount of the polyvinyl alcohol was changed to 50 parts and no cationic agent was used.

Example 6

An ink jet-printing medium of this Example was produced in the same manner as in Example 5 except that the amount of the cellulose fine powder was changed to 80 parts, and 20 parts of alumina having an average particle size of 13 nm (Aluminum Oxide C available from Nippon Aerosil Co., Ltd.) was added.

Example 7

An ink jet-printing medium of this Example was produced in the same manner as in Example 1 except that the amount of the cellulose fine powder was changed to 60 parts, and 40 parts of silica having an average particle size of 17.5 μm (CARPLEX BS-304F available from SHIONOGI & Co., Ltd.) was added.

Example 8

An ink jet-printing medium of this Example was produced in the same manner as in Example 1 except that silk fine powder having an average particle size of 10 μm (available from TOSCO Central Laboratory) was used in place of the cellulose fine powder (ARBOCEL BE600-1).

Example 9

An ink jet-printing medium of this Example was produced in the same manner as in Example 1 except that natural wool fine powder having an average particle size of 15 μm (available from TOSCO Central Laboratory) was used in place of the cellulose fine powder (ARBOCEL BE600-1).

Comparative Example 1

An ink jet-printing medium of this Example was produced in the same manner as in Example 1 except that silica (CARPLEX BS-304F available from SHIONOGI & Co., Ltd.) was used in place of the cellulose fine powder (ARBOCEL BE600-1).

Comparative Example 2

An ink jet-printing medium of this Example was produced in the same manner as in Example 7 except that the amounts of the cellulose fine powder and silica were changed to 40 parts and 60 parts respectively.

Comparative Example 3

An ink jet-printing medium of this Example was produced in the same manner as in Example 1 except that cellulose fine powder having an average particle size of 120 μm and an average diameter of 20 μm (ARBOCEL BE00 available from J. Rettenmaier & Söhne GMBH & CO.) was used in place of ARBOCEL BE600-10.

Comparative Example 4

An ink jet-printing medium of this Example was produced in the same manner as in Example 1 except that silica having an average particle size of 17.5 μm (CARPLEX BS-304F) was used in place of ARBOCEL BE600-10.

With the ink jet-printing media produced in Examples and Comparative Examples, the following properties were measured by the following methods:

1. Printing Properties

Using an ink jet printer (PM-2000C available from EPSON), the surface of the medium was solid printed in a mode for "special glossy paper" with a black ink (B), a cyan ink (C), a magenta ink (M), a yellow ink (Y), a mixture of cyan and magenta (C+M), a mixture of magenta and yellow (C+Y) and a mixture of cyan and yellow (C+Y), and the following properties were evaluated. With all the inks, the ink absorption and drying were good.

1.1 Print Density

After 24 hours from printing, the density of the printed part was measured with a Macbeth densitometer RD 915.

1.2 Feathering

The edges of the printed area was observed and graded according to five ranks (1 to 5). When no feathering appeared and the printed area was sharply limned, the medium was ranked "5", while the feathering was observed in the peripheral part of 0.5 mm or more around the edge or the peripheral part was expanded, the medium was ranked "1".

1.3 Water Resistance

A drop of water was dropped on the edge of the printed area, and the manner of flowing of the print and the coated layer was observed.

2. Discoloration and Fading

The printed media was illuminated with a xenon weatherometer (light source: a xenon lamp (6.5 W)) for 24 hours, and the colors of the print and the background before and after illumination were measured with a color meter (ColorGuide available from BYK-Gardner) in terms of L*, a* and b* values. Then, the degree of discoloration and fading (ΔE) was calculated according to the following formula:

$$\Delta E=[(\Delta L^*)^2+(\Delta a^*)^2+(\Delta b^*)^2]^{1/2}$$

The results are summarized in Table 1.

TABLE 1

| | Print density | | | | Feathering | ΔE Print | | | | |
|---|---|---|---|---|---|---|---|---|---|---|
| | B | C | M | Y | | C | M | Y | B | Note |
| Ex. 1 | 1.6 | 1.6 | 1.7 | 1.6 | 4 | 4 | 11 | 5 | 4 | |
| Ex. 2 | 1.7 | 1.7 | 1.7 | 1.6 | 3 | 5 | 13 | 7 | 5 | |
| Ex. 3 | 1.6 | 1.6 | 1.6 | 1.6 | 5 | 4 | 8 | 4 | 4 | |
| Ex. 4 | 1.6 | 1.6 | 1.6 | 1.6 | 5 | 4 | 7 | 4 | 3 | Water-resistance of the coating and print being high |
| Ex. 5 | 1.6 | 1.6 | 1.5 | 1.4 | 4 | 2 | 7 | 3 | 3 | |
| Ex. 6 | 1.6 | 1.6 | 1.6 | 1.6 | 4 | 3 | 8 | 4 | 3 | |
| Ex. 7 | 1.6 | 1.6 | 1.6 | 1.5 | 4 | 5 | 13 | 10 | 7 | |
| Ex. 8 | 1.5 | 1.6 | 1.4 | 1.6 | 4 | 5 | 13 | 7 | 4 | |
| Ex. 9 | 1.6 | 1.5 | 1.4 | 1.5 | 4 | 6 | 10 | 10 | 8 | |
| C. Ex. 1 | 1.7 | 1.6 | 1.5 | 1.4 | 4 | 6 | 17 | 20 | 9 | |
| C. Ex. 2 | 1.6 | 1.6 | 1.5 | 1.5 | 4 | 5 | 15 | 16 | 9 | |

TABLE 1-continued

| | Print density | | | | Feather- | ΔE Print | | | | |
|---|---|---|---|---|---|---|---|---|---|---|
| | B | C | M | Y | ing | C | M | Y | B | Note |
| C. Ex. 3 | 1.7 | 1.6 | 1.7 | 1.6 | 2 | 4 | 15 | 4 | 4 | |
| C. Ex. 4 | 1.6 | 1.6 | 1.4 | 1.5 | 5 | 4 | 15 | 14 | 9 | |

As can be seen from the results in Table 1, the ink jet-printing media of Examples according to the present invention which comprised the inexpensive fibrous fine powder had the quality comparable with that of the media of Comparative Examples, and excellent resistance to discoloration and fading of the colors.

The invention claimed is:

1. An ink jet-printing medium comprising a substrate and an ink-receptive layer which comprises at least one layer and is formed on at least one major surface of the substrate, wherein at least one layer of the ink-receptive layer contains fibrous fine powder as a pigment in an amount of at least 80% by weight of the total weight of the whole pigment contained in the layer which contains the fibrous fine powder, wherein an average length or average particle size of said fibrous fine powder is 10 to 85 μm, wherein the substrate comprises a paper sheet or a resin film, wherein said fibrous fine powder comprises at least one fibrous material selected from cellulose, cotton, silk, wool and chitosan, and wherein said ink-receptive layer contains 14 to 50% by weight of polyvinyl alcohol, and 4% by weight or less of a cationic agent.

2. The ink jet-printing medium according to claim 1, wherein said at least one layer of the ink-receptive layer further contains a cationic material.

3. The ink jet-printing medium according to claim 2, wherein said cationic material is a compound comprising an amine salt group or an ammonium salt group.

4. The ink jet-printing medium according to claim 2, wherein said cationic material is an aluminum compound or a powder treated with an aluminum compound.

5. The ink jet-printing medium according to claim 4, wherein said aluminum material is at least one material selected from the group consisting of alumina, aluminum hydroxide and hydrous aluminum oxide.

6. The ink jet-printing medium according to claim 1, further comprising a layer which contains at least one pigment selected from the group consisting of silica, alumina and calcium carbonate, wherein said layer is formed on said at least one layer of the ink-receptive layer containing fibrous fine powder.

7. A method for producing an ink jet-printing medium according to claim 1 comprising the steps of:

applying a coating composition comprising fibrous fine powder and a binder on at least one major surface of the substrate, and drying said coating composition applied.

8. An ink jet-printing medium comprising a substrate and an ink-receptive layer which comprises at least one layer and is formed on at least one major surface of the substrate, wherein at least one layer of the ink-receptive layer contains fibrous fine powder capable of absorbing ink as a pigment in an amount of at least 20% by weight of the total weight of the whole pigment contained in the layer which contains the fibrous fine powder, wherein an average length or average particle size of said fibrous fine powder is 10 to 85 μm, and wherein said fibrous fine powder comprises at least one fibrous material selected from cellulose, cotton, silk, wool and chitosan.

9. An ink jet-printing medium comprising a substrate and an ink-receptive layer which comprises at least one layer and is formed on at least one major surface of the substrate, wherein at least one layer of the ink-receptive layer contains fibrous fine powder as a pigment in an amount of at least 80% by weight of the total weight of the whole pigment contained in the layer which contains the fibrous fine powder, wherein an average length or average particle size of said fibrous fine powder is 10 to 85 μm, wherein the substrate comprises a paper sheet or a resin film, wherein said fibrous fine powder comprises at least one fibrous material selected from cellulose, cotton, silk, wool and chitosan, and wherein said ink-receptive layer contains 14 to 50% by weight of polyvinyl alcohol based on the fibrous fine powder.

* * * * *